US010422326B2

(12) United States Patent
Sato

(10) Patent No.: US 10,422,326 B2
(45) Date of Patent: Sep. 24, 2019

(54) HIGH PRESSURE GENERATOR WITH BIDIRECTIONAL CHECK VALVES CONTROLLING OVERPRESSURE

(71) Applicant: SUGINO MACHINE LIMITED, Uozu, Toyama Prefecture (JP)

(72) Inventor: Sho Sato, Uozu (JP)

(73) Assignee: SUGINO MACHINE LIMITED, Uozu, Toyama Prefecture (JP)

( * ) Notice: Subject to any disclaimer, the term of this patent is extended or adjusted under 35 U.S.C. 154(b) by 146 days.

(21) Appl. No.: 15/801,399

(22) Filed: Nov. 2, 2017

(65) Prior Publication Data

US 2018/0149145 A1 May 31, 2018

(30) Foreign Application Priority Data

Nov. 30, 2016 (JP) ..... 2016-232005

(51) Int. Cl.
*F04B 9/105* (2006.01)
*F04B 1/18* (2006.01)
(Continued)

(52) U.S. Cl.
CPC ..... *F04B 9/1053* (2013.01); *F04B 1/182* (2013.01); *F04B 5/02* (2013.01); *F04B 7/003* (2013.01);
(Continued)

(58) Field of Classification Search
CPC ..... F04B 9/1053; F04B 1/182; F04B 5/00; F04B 7/0208; F04B 7/0003; F04B 7/0084; F04B 7/0266; F04B 9/1056; F04B 9/111
(Continued)

(56) References Cited

U.S. PATENT DOCUMENTS 3,516,763 A * 6/1970 Manton ..... F01L 25/04 417/403
3,893,790 A * 7/1975 Mayer ..... F01L 25/04 417/346
(Continued)

FOREIGN PATENT DOCUMENTS

EP 2998579 A2 3/2016
JP 2016-061249 A 4/2016

*Primary Examiner* — Bryan M Lettman
*Assistant Examiner* — Timothy P Solak
(74) *Attorney, Agent, or Firm* — United IP Counselors, LLC

(57) ABSTRACT

An ultrahigh pressure generator is disclosed. The ultrahigh pressure generator has a pressure intensifier that discharges a fluid at ultrahigh pressure. The pressure intensifier uses a working medium and includes a double acting drive cylinder with a first compartment and a second compartment that are separated by a piston. A closed-circuit working medium pump drives the pressure intensifier by sucking and discharging the working medium from and to the first and second compartments. A collector collects the working medium from the first and second working medium channels into a tank. A low-pressure selector selects whether the working medium is discharged from the first or second compartment when the pressure of the working medium discharged toward the first or second compartment exceeds a predetermined threshold, and directs the selected working medium to the collector. The pressure generator manages the temperature of the working fluid appropriately.

6 Claims, 2 Drawing Sheets

(51) Int. Cl.

| | |
|---|---|
| ***F04B 51/00*** | (2006.01) |
| ***F04B 49/22*** | (2006.01) |
| ***F04B 9/113*** | (2006.01) |
| ***F04B 23/06*** | (2006.01) |
| ***F04B 49/00*** | (2006.01) |
| ***F04B 5/02*** | (2006.01) |
| ***F04B 7/02*** | (2006.01) |
| ***F04B 7/00*** | (2006.01) |
| ***F04B 23/02*** | (2006.01) |

(52) U.S. Cl.
CPC ..... *F04B 7/0084* (2013.01); *F04B 7/02* (2013.01); *F04B 9/1056* (2013.01); *F04B 9/113* (2013.01); *F04B 23/06* (2013.01); *F04B 49/002* (2013.01); *F04B 49/22* (2013.01); *F04B 51/00* (2013.01); *F04B 23/02* (2013.01)

(58) Field of Classification Search
USPC ..... 417/225
See application file for complete search history.

(56) References Cited

U.S. PATENT DOCUMENTS

| | | | | |
|---|---|---|---|---|
| 4,606,709 | A | 8/1986 | Chisolm | |
| 5,385,452 | A * | 1/1995 | Lyday | F01B 11/02 417/403 |
| 5,634,773 | A * | 6/1997 | Tanino | F04B 9/1178 417/46 |
| 2016/0084241 | A1 | 3/2016 | Sato | |

* cited by examiner

HIGH PRESSURE GENERATOR WITH BIDIRECTIONAL CHECK VALVES CONTROLLING OVERPRESSURE

CROSS-REFERENCE TO RELATED APPLICATIONS

This application claims the benefit of priority to Japanese Patent Application No. 2016-232005, filed on Nov. 30, 2016, the entire contents of which are hereby incorporated by reference.

BACKGROUND

1. Technical Field

The present invention relates to an ultrahigh pressure generator including a pressure intensifier that discharges a pressurized fluid.

2. Description of the Background

An ultrahigh pressure generator including a closed-circuit working medium pump has been known. The closed-circuit working medium pump in the ultrahigh pressure generator shown in FIG. 1 of Japanese Unexamined Patent Application Publication No. 2016-61249 sucks a working medium from the pressed area in the pressure intensifier, and pressurizes and returns the working medium to the pressing area. This eliminates the need for a directional control valve that redirects the flow of the working medium to be fed to a first compartment and a second compartment. An abnormal pressure rise in a fluid under high pressure, which can be caused by the directional control valve due to its pressure loss while the discharge remains stopped, may thus be eliminated. A closed circuit, which involves no working medium replacement, allows easy maintenance. The working medium releases pressure while being sucked in the working medium pump, and thus has high energy efficiency.

BRIEF SUMMARY

However, the working medium moves within a limited area in the closed circuit. A large number of movements can increase the temperature of the working medium, and may thus reduce the viscosity of the working medium. This may decrease the energy efficiency.

One or more aspects of the present invention are directed to an ultrahigh pressure generator that allows appropriate management of the temperature of the working medium.

An ultrahigh pressure generator according to an embodiment includes

- a pressure intensifier configured to discharge a fluid, the pressure intensifier including
  - a piston configured to be driven by a working medium,
  - a double-acting drive cylinder having a first compartment and a second compartment that are separated by the piston,
  - a high-pressure cylinder configured to discharge the fluid, and
  - a plunger configured to reciprocate in the high-pressure cylinder together with the piston;
- a closed-circuit working medium pump having a first port and a second port being an inlet port and an outlet port for the working medium, the closed-circuit working medium pump being configured to drive the pressure intensifier by sucking and discharging the working medium from and to the first compartment and the second compartment respectively through the first port and the second port;

- a first working medium channel connecting the first compartment and the first port;
- a second working medium channel connecting the second compartment and the second port;
- a tank configured to store the working medium;
- a feed circuit configured to feed the working medium from the tank to the first working medium channel and the second working medium channel;
- a collector configured to collect the working medium from the first working medium channel and the second working medium channel into the tank; and
- a low-pressure selector configured to select, when the pressure of the working medium discharged toward the first compartment or the second compartment exceeds a predetermined threshold, the working medium discharged from one of the first compartment and the second compartment, and direct the selected working medium to the collector.

The ultrahigh pressure generator according to the embodiment of the present invention allows appropriate management of the temperature of the working medium to improve the energy efficiency and achieve stable operations.

DETAILED DESCRIPTION

Figure 1:
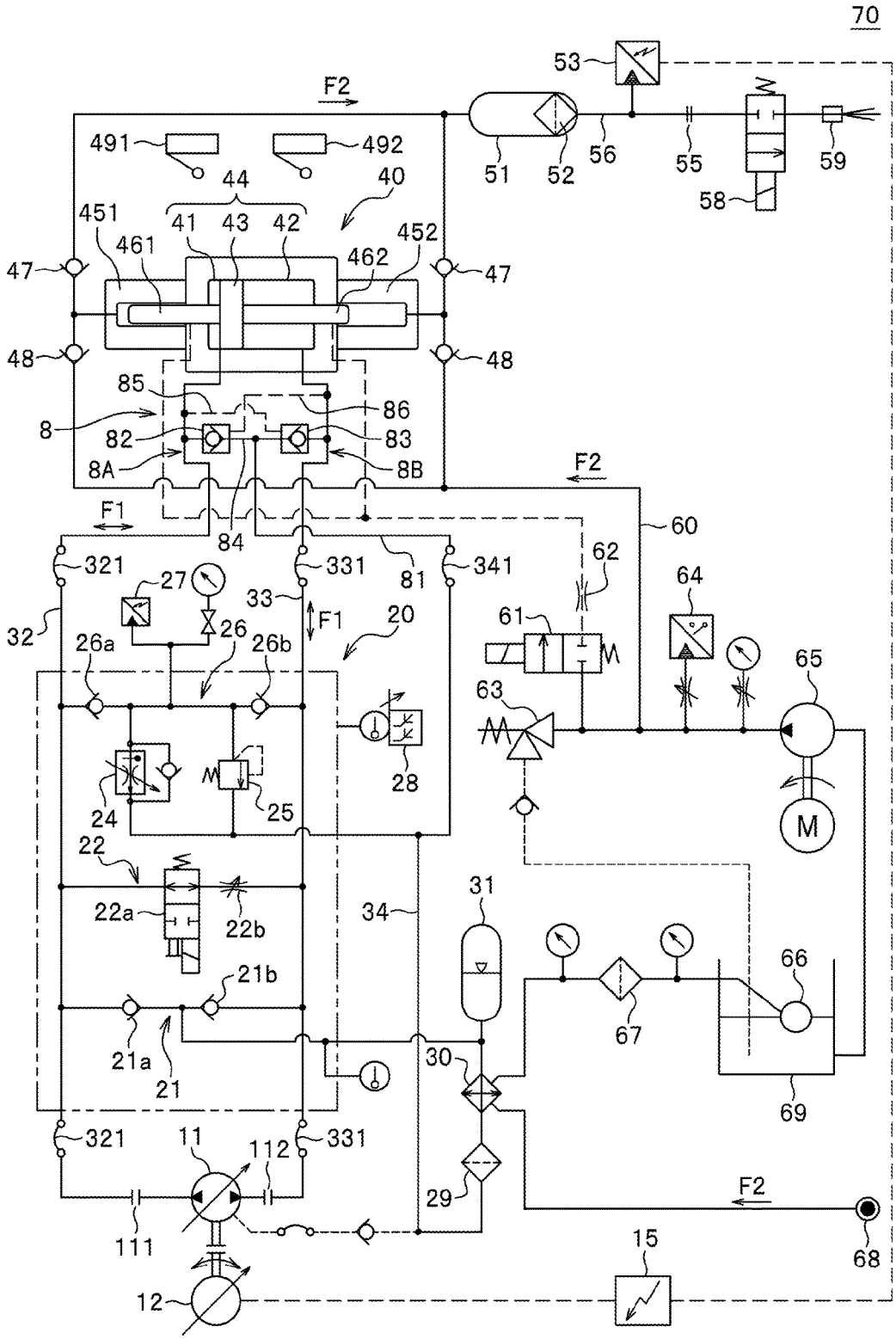
FIG. 1 is a circuit diagram showing a hydraulic circuit in an ultrahigh pressure generator according to an embodiment.

An ultrahigh pressure generator 70 according to an embodiment will now be described in detail with reference to FIG. 1. A working medium F1 is a hydraulic oil. A fluid F2 to be pressurized is water. The fluid F2 to be pressurized is hereafter simply referred to as the fluid F2. The ultrahigh pressure generator 70 is, for example, a waterjet cutter that continuously discharges ultrahigh pressure water.

The ultrahigh pressure generator 70 continuously discharges the fluid F2 to generate ultrahigh pressure. The ultrahigh pressure generator 70 includes a pressure intensifier 40, a closed-circuit working medium pump 11, a reversible driving source 12, a first working medium channel 32, a second working medium channel 33, a low-pressure selector 8, a high-pressure selector 26, a feed circuit 21, a pressure equalizer 22, and a collector 34. The closed-circuit working medium pump 11 has an inlet-outlet first port 111 and an inlet-outlet second port 112. The reversible driving source 12 drives the closed-circuit working medium pump 11. The first working medium channel 32 connects a first compartment 41 and the first port 111. The second working medium channel 33 connects a second compartment 42 and the second port 112.

The pressure intensifier 40 includes a piston 43, a double-acting drive cylinder 44, and plungers 461 and 462. The double-acting drive cylinder 44 includes the first compartment 41 and the second compartment 42. The first compartment 41 and the second compartment 42 are separated by the piston 43, which is driven by the working medium F1. The plungers 461 and 462 reciprocate in high-pressure cylinders 451 and 452 together with the piston 43.

The closed-circuit working medium pump 11 is, for example, a fixed displacement swash-plate axial pump. The reversible driving source 12 is, for example, a servomotor.

The ultrahigh pressure generator 70 further includes a pressure detector 53 and a controller 15. The pressure detector 53 measures the pressure of the fluid F2 discharged from the pressure intensifier 40. The controller 15 controls the number of revolutions of the reversible driving source 12 in accordance with the pressure detected by the pressure detector 53.

The ultrahigh pressure generator 70 also includes a feed port 68, a heat exchanger 30, and a reservoir 69. The feed port 68 feeds the fluid F2. The heat exchanger 30 cools the working medium F1. The reservoir 69 stores the fluid F2. The fluid F2 fed through the feed port 68 passes through the heat exchanger 30 and enters the reservoir 69.

The intensification ratio is the ratio between the cross-sectional area of the piston 43 and that of the high-pressure cylinders 451 and 452. The fluid F2 is pressurized to have a pressure obtained by multiplying the pressure of the working medium F1 by the intensification ratio. The intensification ratio is, for example, tens. The plungers 461 and 462 are reciprocated by the double-acting drive cylinder 44 horizontally in the high-pressure cylinders 451 and 452. The distal end of the high-pressure cylinder 451 includes an inlet valve 48 and an outlet valve 47. The distal end of the high-pressure cylinder 452 also includes another inlet valve 48 and another outlet valve 47. When the working medium F1 pressurizes the first compartment 41, the piston 43 moves to the right in the figure. In this state, the fluid F2 flows into the high-pressure cylinder 451 through the inlet valve 48. The fluid F2 flows out of the high-pressure cylinder 452 into the outlet valve 47. When the piston 43 moves to the right (rightward) in the figure and reaches around the right end, a right-end detector 492 detects the piston 43, and the piston 43 is redirected leftward in the figure. Similarly, a left-end detector 491 detects that the piston 43 reaches around the left end. In the left (leftward) movement of the piston 43 in the figure, the operation described above is reversed from right to left. The fluid F2 is discharged continuously as the double-acting drive cylinder 44 reciprocates.

The left-end detector 491 and the right-end detector 492 are detection devices such as proximity switches or limit switches. The proximity switches arranged in the pressure intensifier 40 simplify the structure.

The inlet valve 48 and the outlet valve 47, which are a pair of check valves, may be directional flow regulation valves. An ultrahigh pressure generator that is a one-shot device, rather than a continuous discharge device, eliminates the outlet valve 47.

When the piston 43 moves rightward, the closed-circuit working medium pump 11 pressurizes the working medium F1 in the second compartment 42 to a predetermined pressure and feeds the pressurized working medium to the first compartment 41. In contrast, when the piston 43 moves leftward, the closed-circuit working medium pump 11 feeds the working medium F1 in the first compartment 41 to the second compartment 42. The closed-circuit working medium pump 11 controls the pressure and the flow rate by changing the number of revolutions. The reversible driving source 12 can control the number of revolutions as appropriate, and maintain an angle at which its output shaft does not rotate. The combination of a fixed displacement swash-plate axial pump and a reversible servomotor can control the pressure and the flow rate of the working medium F1, and allow the flow rate to be 0 while maintaining the pressure of the working medium F1. The fixed displacement swash-plate axial pump also increases the reliability.

In the continuous discharge of the fluid F2, when the direction of a flow from the closed-circuit working medium pump 11 is reversed, the pressure of the first compartment 41 or the second compartment 42 that has been in a compression process becomes almost 0 MPa. Immediately after that, the opposite compartment is pressurized. The pressure of the working medium F1 temporarily becomes substantially 0 MPa when the double-acting drive cylinder is redirected. No abnormal pressure rise thus occurs while the cylinder is being redirected.

The combination of the closed-circuit working medium pump 11 and the reversible driving source 12 may be replaced with the combination of a variable displacement axial plunger pump, which has a positive-negative reversible tilt angle, and a unidirectional driving source. The variable displacement plunger pump with a reversible tilt angle, which allows the two ports to switch between the inlet and the outlet by reversing the tilt angle, can function as a closed-circuit working medium pump.

A valve block 20 is connected with the pressure intensifier 40 by rubber hoses 321, 331, and 341. The valve block 20 is connected with the closed-circuit working medium pump 11 by the rubber hoses 321 and 331. The rubber hoses 321, 331, and 341 absorb vibrations caused in each component. The ultrahigh pressure generator 70 thus improves durability, and also eases assembling and maintenance.

The valve block 20 includes a temperature detector 28 for detecting the temperature of the working medium. Upon an abnormal rise in the temperature of the working medium F1, the temperature detector 28 provides an alarm. The temperature detector 28, which does not come into contact with the working medium F1, is less likely to be damaged by fluctuations in the pressure of the working medium F1 or other factors.

With no damage being expected, the temperature detector 28 may be connected to the feed circuit 21 or the high-pressure selector 26.

The low-pressure selector 8 includes a low-pressure channel 81, a first check valve 82, a second check valve 83, a check valve connection channel 84, a first switch channel 85, and a second switch channel 86. The low-pressure channel 81 connects the check valve connection channel 84 to the collector 34. The first check valve 82 has its upstream end connecting to the low-pressure channel 81 and its downstream end connecting to the first working medium channel 32. The second check valve 83 has its upstream end connecting to the low-pressure channel 81 and its downstream end connecting to the second working medium channel 33. The check valve connection channel 84 connects the upstream end of the first check valve 82 to the upstream end of the second check valve 83. The first switch channel 85 connects the first working medium channel 32 to the upstream end of the second check valve 83. The second switch channel 86 connects the second working medium channel 33 to the upstream end of the first check valve 82.

The first check valve 82 and the second check valve 83 are pilot check valves that open in response to pilot pressure. The upstream ends of the first check valve 82 and the second check valve 83 connect to the collector 34 through the check valve connection channel 84 and the low-pressure channel 81. The first switch channel 85 opens the second check valve 83 when the pressure of the working medium F1 discharged from the first compartment 41 exceeds a predetermined threshold. When the second check valve 83 is open, the working medium F1 is directed from the second working medium channel 33 to the low-pressure channel 81 through the second check valve 83. The second switch channel 86 opens the first check valve 82 when the pressure of the working medium F1 discharged from the second compartment 42 exceeds a predetermined threshold. When the first check valve 82 is open, the working medium F1 is directed from the first working medium channel 32 to the low-pressure channel 81 and the collector 34 through the first check valve 82.

The predetermined threshold is preset based on the pressure of the working medium F1 discharged from the first compartment 41 and the second compartment 42, and the pressure difference between the first compartment 41 and the second compartment 42. The setting is based on the uses and specifications of the ultrahigh pressure generator 70.

When the pressure of the working medium F1 discharged from the first compartment 41 or the second compartment 42 exceeds the predetermined threshold, the low-pressure selector 8 selects the working medium F1 discharged toward the first compartment 41 or the second compartment 42, and directs the selected working medium F1 to the collector 34.

The low-pressure selector 8 includes a first low-pressure selector switch circuit 8A and a second low-pressure selector switch circuit 8B. The first low-pressure selector switch circuit 8A selects the working medium F1 discharged toward the first compartment 41 through the first port 111, and directs the selected working medium F1 to the collector 34. The second low-pressure selector switch circuit 8B selects the working medium F1 discharged toward the second compartment 42 through the second port 112, and directs the selected working medium F1 to the collector 34.

Figure 2A:
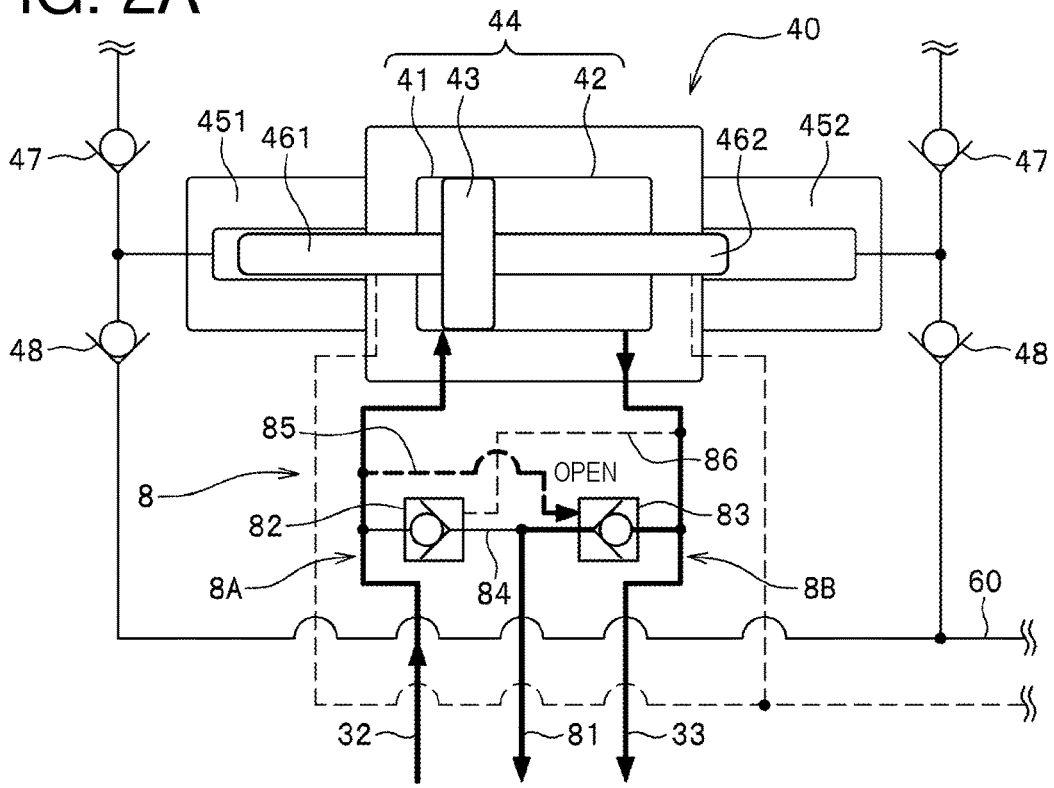
FIG. 2A is a circuit diagram showing the main components of a first low-pressure selector in the ultrahigh pressure generator according to the embodiment for describing the operation of the selector.

As shown in FIG. 2A, the first low-pressure selector switch circuit 8A includes the first check valve 82 and the second check valve 83, and the first switch channel 85. When the working medium F1 is discharged from the first working medium channel 32 to the first compartment 41 and the piston 43 moves to the right in the figure, the first compartment 41 has the higher pressure, whereas the second compartment 42 has the lower pressure. When the pressure of the working medium F1 discharged toward the first compartment 41 exceeds the predetermined threshold, the first low-pressure selector switch circuit 8A selects the working medium F1 discharged from the second compartment 42. The first low-pressure selector switch circuit 8A then opens the second check valve 83 through the first switch channel 85. This causes the working medium F1 discharged from the second compartment 42 under the lower pressure and flowing toward the second working medium channel 33 to branch to the low-pressure channel 81 through the second check valve 83 and flow to the collector 34. The first check valve 82 in this state prevents the working medium F1 under the higher pressure discharged by the closed-circuit working medium pump 11 toward the first compartment 41 from flowing into the check valve connection channel 84 from the first working medium channel 32.

The low-pressure selector 8 may be arranged between the high-pressure selector 26 and the pressure intensifier 40. This arrangement causes the pressure difference between the working mediums F1 under the higher pressure and the lower pressure to be larger than the pressure difference caused by an arrangement with the low-pressure selector 8 near to the closed-circuit working medium pump 11. This larger pressure difference can smooth the operation of the first low-pressure selector switch circuit 8A. The smooth operation efficiently causes the working medium F1 under the lower pressure discharged toward the pressure intensifier 40 to flow to the collector 34.

Figure 2B:
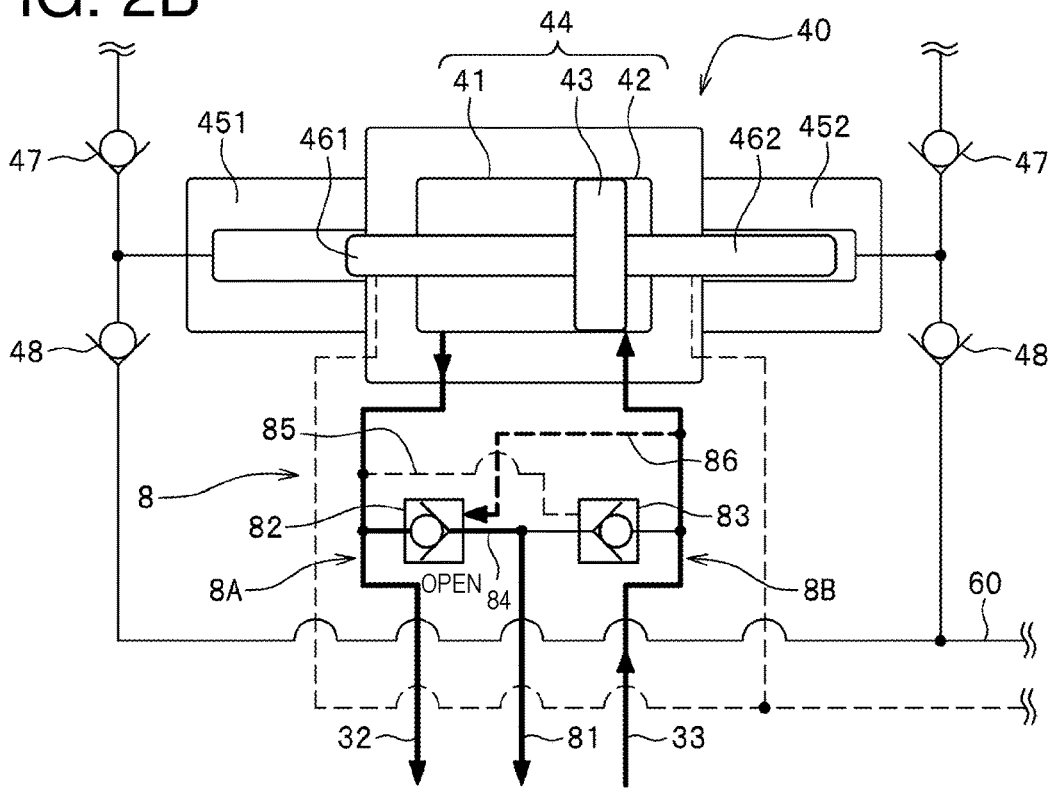
FIG. 2B is a circuit diagram showing the main components of a second low-pressure selector in the ultrahigh pressure generator according to the embodiment for describing the operation of the selector.

As shown in FIG. 2B, the second low-pressure selector switch circuit 8B includes the first check valve 82 and the second check valve 83, and the second switch channel 86. When the working medium F1 is discharged from the second working medium channel 33 to the second compartment 42 and the piston 43 moves to the left in the figure, the second compartment 42 has the higher pressure, whereas the first compartment 41 has the lower pressure. When the pressure of the working medium F1 discharged toward the second compartment 42 exceeds the predetermined threshold, the second low-pressure selector switch circuit 8B selects the working medium F1 discharged from the first compartment 41. The second low-pressure selector switch circuit 8B then opens the first check valve 82 through the second switch channel 86. This causes the working medium F1 discharged from the first compartment 41 under the lower pressure and flowing toward the first working medium channel 32 to branch to the low-pressure channel 81 through the first check valve 82 and flow to the collector 34. The second check valve 83 in this state prevents the working medium F1 under the higher pressure discharged by the closed-circuit working medium pump 11 toward the second compartment 42 from flowing into the check valve connection channel 84 from the second working medium channel 33. The second low-pressure selector switch circuit 8B has the same structure as the first low-pressure selector switch circuit 8A, and will not be described redundantly.

The first working medium channel 32 and the second working medium channel 33 are connected by the high-pressure selector 26 including a pair of check valves 26*a* and 26*b*.

The high-pressure selector 26 selects the working medium F1 discharged from one of the first compartment 41 and the second compartment 42 and to be sucked by the working medium pump 11 through the first port 111 and the second port 112. The high-pressure selector 26 directs the selected working mediums F1 to the collector 34.

The upstream end of the check valve 26*a* connects to the working medium channel 32, and the upstream end of the check valve 26*b* connects to the working medium channel 33. The high-pressure selector 26 includes a pressure detector 27 for detecting the pressure of the working medium F1. The high-pressure selector 26 causes the pressure detector 27 to detect the pressure of one of the first working medium channel 32 and the second working medium channel 33 that has the higher pressure. This simple structure can detect the pressure. The pressure detector 27 may provide an alarm when the pressure of the working medium F1 falls out of its normal range.

The first working medium channel 32 and the second working medium channel 33 are connected by the feed circuit 21 including a pair of check valves 21*a* and 21*b* located upstream from the working medium channels 32 and 33. The feed circuit 21 connects between the check valves 21*a* and 21*b* to a working medium tank 31. The working medium tank 31 is under internal pressure. Although the working medium F1, which is a hydraulic oil, is an incompressible fluid, the pressurization slightly compresses the working medium F1. In the pressure intensifier 40, one of the first compartment 41 and the second compartment 42 that is feeding a fluid normally has a pressure of about 0 MPa, whereas the other compartment has a preset pressure. Under this condition, the total amount of working medium F1 accumulating in the system varies in accordance with the volume of the working medium F1 in the piping and one of the first compartment 41 and the second compartment 42 undergoing the compression process. The feed circuit 21 controls the total amount of working medium F1. The working medium tank 31 may simply control the total amount of working medium F1, and thus can be compact. The working medium tank 31 is equivalent to a thin accumulator for gas, and thus can dissipate heat of the working medium F1.

The pressure equalizer 22 includes an electromagnetic valve 22*a* and a throttle 22*b* for operating the pressure intensifier 40, and connects the first working medium channel 32 and the second working medium channel 33. The electromagnetic valve 22*a* disconnects the pressure equalizer 22 before the closed-circuit working medium pump 11 rotates. When the closed-circuit working medium pump 11 stops rotating, the electromagnetic valve 22*a* connects the pressure equalizer 22. When the pressure equalizer 22 is connected, the first working medium channel 32 and the second working medium channel 33 have the same pressure to stop the pressure intensifier. The electromagnetic valve 22*a*, which is normally open, connects the pressure equalizer 22 when the power supply stops in an emergency. The electromagnetic valve 22*a* thus serves as a safety circuit. The throttle 22*b* prevents impact pressure damage to the hydraulic equipment. The impact pressure damage may be caused by an abrupt pressure change when the pressure equalizer 22 is connected. Additionally, a large amount of working medium F1 in the system may cause fluctuations in the pressure of the working medium F1 when the electromagnetic valve 22*a* is open and closed. However, when a small total amount of working medium F1 is unlikely to cause large pressure fluctuations, the throttle 22*b* may not be used.

The pressure equalizer 22 may be eliminated when other safety measures are provided.

The collector 34 connects the low-pressure selector 8 and the high-pressure selector 26 to the working medium tank 31. The collector 34 collects the working medium F1 from the low-pressure selector 8 and the high-pressure selector 26 into the working medium tank 31. The collector 34 includes a filter 29 and the heat exchanger 30 that are connected in series. The collector 34 is also connected to the high-pressure selector 26 through a safety valve 25 and a flow regulation valve 24 that are connected in parallel.

The safety valve 25 maintains the pressure of the working medium F1 at a set value or less if the servo system of the closed-circuit working medium pump 11 is out of control. In this manner, the safety valve 25 protects the ultrahigh pressure generator 70 from an abrupt increase in the pressure. The flow regulation valve 24 regulates the amount of working medium F1 pressurized to a high pressure and collected by the collector 34 from the high-pressure selector 26 into the working medium tank 31. As described above, the working medium tank 31 controls the amount of working medium F1 in the system as the piston 43 in the pressure intensifier 40 reciprocates. The collector 34 feeds the working medium F1 to the working medium tank 31 as appropriate. When the working medium F1 is collected into the working medium tank 31, the working medium F1 is filtered through the filter 29 and cooled by the heat exchanger 30. As described above, when the piston 43 is redirected, the working medium F1 is fed from the working medium tank 31 through the feed circuit 21, and the working medium F1 is returned from the low-pressure selector 8 and the high-pressure selector 26 to the working medium tank 31. In this manner, a fixed amount of working medium F1 flows in the circuits through the working medium tank 31 in accordance with the operation of the pressure intensifier 40. Thus, the working medium F1 is constantly cooled by the heat exchanger 30, and the temperature of the working medium F1 remains constant.

The working medium F1 collected by the collector 34 is a leak from the working medium F1 boosted by the closed-circuit working medium pump 11. The leak can deteriorate the mechanical efficiency. Collecting the working medium F1 from the high-pressure selector 26 through the flow regulation valve 24 regulates the amount of leak appropriately, and thus prevents the mechanical efficiency from deteriorating greatly.

The flow regulation valve 24 regulates the flow rate of the working medium F1 flowing into the heat exchanger 30 to a specified amount. The coolant for the heat exchanger 30 is the fluid F2. All the fluid F2 flows into the heat exchanger 30, and may excessively increase the amount of heat collected by the heat exchanger 30. However, the amount of collected heat can be controlled by appropriately regulating the flow rate of the higher-temperature working medium F1 flowing into the heat exchanger 30.

When other safe measures are provided against an abnormal pressure rise, the safety valve 25 may be eliminated. When a small amount of heat is generated in the system to allow the working medium F1 to be sufficiently cooled by the outside air, the heat exchanger 30 may be eliminated.

When the amount of leak from the closed-circuit working medium pump 11 can supplement the amount of working medium F1 to be fed from the working medium tank 31, the flow regulation valve 24 and its connection piping may be eliminated. With no safety valve 25 and no flow regulation valve 24, the collector 34 is also eliminated. In this case, the leak from the closed-circuit working medium pump 11 covers all the working medium to be fed.

The fluid F2 fed from the feed port 68 passes through the heat exchanger 30, is filtered through a filter 67, and then enters the reservoir 69. The fluid F2 is fed to the reservoir 69 through a ball tap 66, and its feeding is stopped when the liquid level in the reservoir 69 reaches the upper limit. The filter 67 and the heat exchanger 30 may be arranged in the reversed order.

A vortex pump 65 sucks the fluid F2 from the bottom of the reservoir 69, and feeds the fluid F2 through a feed channel 60 to the inlet valves 48 for the pressure intensifier 40.

The feed channel 60 includes a safety valve 63. When the discharge of the fluid F2 is stopped, the safety valve 63 prevents the outlet port of the vortex pump 65 from being totally closed, and thus prevents the vortex pump 65 from being damaged. A leak of the fluid F2 through the inlet valve 48 can cause the fluid F2 with an ultrahigh pressure to flow into the feed channel 60. The safety valve 63 prevents the device from being damaged in such an emergency.

The feed channel 60 has an electromagnetic valve 61 that feeds packing cooling water. When the electromagnetic valve 61 is open, the packing cooling water flows through a throttle 62 to packings (not shown) for sealing between the high-pressure cylinders 451 and 452, and the plungers 461 and 462, and cools the packings. A pressure switch 64 for detecting the feed pressure is arranged on the feed channel 60. The pressure switch 64 monitors whether the pressure at which the fluid F2 is fed to the pressure intensifier 40 exceeds the cracking pressure (preset pressure) of the inlet valve 48.

The pressure switch 64 may be replaced with a pressure detector.

The outlet valves 47 are connected to an outlet port 55 by a discharge pipe 56 through an accumulator 51. The accumulator 51 contains a filter 52. The filter 52 contained in the accumulator 51 receives both external and internal ultrahigh pressure. The filter 52 may be a filter with a normal pressure class.

The ultrahigh pressure fluid F2 discharged from the outlet port 55 is jetted from a nozzle 59 through an on-off valve 58. The pressure detector 53 for detecting the pressure of the ultrahigh pressure fluid F2 is arranged on the discharge pipe 56.

The controller 15 controls the pressure and the flow rate of the closed-circuit working medium pump 11 and the moving direction of the pressure intensifier 40 in accordance with the position of the piston 43 in the pressure intensifier 40 and the pressure of the fluid F2 detected by the pressure detector 53. The pressure feedback is determined based on an increase in the pressure. The pressure control is achieved as appropriate by modern control with high robustness, such as adaptive control.

In this manner, the pressure and the flow rate of the closed-circuit working medium pump 11 are regulated based on the actual discharge pressure to optimize the speed of the plungers 461 and 462. The pressure waveform of the fluid F2 is thus substantially linear along the set pressure. At the same time as when the piston 43 is directed at predetermined regular time intervals, the pressure decreases temporarily.

While the continuous discharge remains stopped, the rotation of the closed-circuit working medium pump 11 is stopped and is maintained by the reversible driving source 12. In this state, the working medium F1 to be pressurized in the closed-circuit working medium pump 11 does not flow. Thus, the first and second working medium channels 32 and 33 have no pressure loss, and the pressure of the working medium F1 increases slightly. The pressure of the fluid F2, which is obtained by multiplying the pressure of the working medium F1 by the intensification ratio, also increases. The pressure increase in the fluid F2 ($\Delta P$) is obtained by multiplying the pressure increase in the working medium F1 by the intensification ratio. The number of revolutions of the closed-circuit working medium pump 11 is controlled based on the pressure feedback, and thus $\Delta P$ is minimized. When the continuous discharge is resumed, the pressure of the fluid F2 is stable again at around the set pressure.

An ultrahigh pressure generator that produces a pressure on the order of 600 MPa as in the present embodiment uses the intensification ratio of nearly 30. As the pressure increases, the intensification ratio also increases. The pressure increases more while the discharge remains stopped. Under extremely high pressure, the ultrahigh pressure fluid causes high internal stress in the pressure piping. The pressure fluctuates, and thus limits the materials, thickness, and internal surfacing of the pressure piping. The pressure increase and pressure fluctuations of the ultrahigh pressure fluid apply can cause excessive loads on the ultrahigh pressure generator and the pressure piping system.

The pipes, valves, hoses, joints, and other pipe fittings used for ultrahigh pressure piping can have excessive internal stress. The ultrahigh pressure generator 70 in the present embodiment has very small pressure fluctuations and thus have a longer piping life. The ultrahigh pressure generator 70 is thus suitable as an ultrahigh pressure generator that generates particularly high pressure.

The ultrahigh pressure generator 70 in the present embodiment has the advantageous effects described below. When the pressure of the working medium F1 discharged from the first compartment 41 or the second compartment 42 exceeds the predetermined threshold, the low-pressure selector 8 selects the working medium F1 discharged toward the first compartment 41 or toward the second compartment 42, and directs the selected working medium F1 to the collector 34 to allow circulation of the working medium F1.

This operation enables appropriate management of the temperature of the working medium F1 using the heat exchanger 30 or other components, and effectively improves the energy efficiency (mechanical efficiency).

Additionally, the low-pressure selector 8 greatly improves the mechanical efficiency, and reduces heat produced from the ultrahigh pressure generator 70. This greatly reduces the amount of water for cooling the working medium F1. This allows the discharge amount of fluid F2 to match such less cooling water, and the fed fluid F2 to be first used as the cooling water. The low flow rate of the fluid F2 can downsize the reservoir 69.

Further, the ultrahigh pressure generator 70 improves the mechanical efficiency, and may have smaller machine components and a simpler structure. This downsizes the entire device.

In the present embodiment, the closed-circuit working medium pump 11 is controlled in accordance with the pressure detected by the pressure detector 53. The discharge pressure is thus maintained constant at around the set pressure. The constant discharge pressure stabilizes the flow speed and the flow rate of the jet of the fluid F2 jetted from the nozzle 59. The stable pressure waveform reduces the capacity of the accumulator 51. The accumulator 51, which is a pressure vessel, can have very high internal stress. The internal stress increases in proportion to the square of the inner diameter of the accumulator. The energy accumulating in the accumulator is proportional to the internal volume. For an ultrahigh pressure generator that generates a particularly ultrahigh pressure over 600 MPa, the manufacture of a large-volume accumulator has very difficult technical challenges. The ultrahigh pressure generator 70 in the present embodiment, which can have a stable pressure waveform and may include an accumulator having a smaller volume, is usable for an ultrahigh pressure generator that generates particularly high pressure.

In the present embodiment, the plungers 461 and 462 and the high-pressure cylinders 451 and 452 are arranged at both ends of the double-acting drive cylinder 44. In this structure, when the piston 43 is redirected, the pressure of the ultrahigh pressure fluid F2 in the high-pressure cylinder 451 or 452 immediately after the compression process acts on the piston 43 through the corresponding one of the plungers 461 and 462. In this state, the fluid F2 in the high-pressure cylinder 451 or 452 expands. Additionally, the working medium F1 is slightly compressed. The compressed working medium F1 expands during such redirecting. In this manner, when the piston 43 is redirected, the working medium F1 immediately after being pressurized flows into the closed-circuit working medium pump 11. This structure reduces a load on the closed-circuit working medium pump 11 applied when the rotational directions of the closed-circuit working medium pump 11 and the reversible driving source 12 are reversed.

The present invention is not limited to the structure of the ultrahigh pressure generator 70 described in the embodiment above. For example, the low-pressure selector 8 may not include the first check valve 82 and the second check valve 83, and may include a pressure sensor and switch valves (solenoid valves). The pressure sensor detects the pressures in the first compartment 41 and the second compartment 42. When the sucking compartment reaches a predetermined pressure or when the pressure difference between the discharging and the sucking compartments reaches a predetermined threshold, the switch valve adjacent to the lower-pressure compartment may be turned on.

The reversible driving source 12 may not be a servomotor, and may be any device capable of controlling the torque and the number of revolutions, and maintaining the rotation.

The pressure equalizer 22, the electromagnetic valve 22*a*, the throttle 22*b*, the flow regulation valve 24, and the safety valve 25 may be replaced with an electromagnetic pressure relief valve in the collector 34. In this case, when the operation of the pressure intensifier 40 stops, the electromagnetic pressure relief valve is open to lower the pressure in the working medium channels 32 and 33. When the pressure intensifier 40 restarts the operation, the electromagnetic pressure relief valve is closed.

The ultrahigh pressure generator 70 in the embodiment may be used for purposes other than water jetting, including testing fatigue failure under pressure and hydroforming.

REFERENCE SIGNS LIST

8 low-pressure selector
11 closed-circuit working medium pump
111 first port
112 second port
12 reversible driving source (driving source)
15 controller
21 feed circuit
22 pressure equalizer
26 high-pressure selector
30 heat exchanger
31 working medium tank (tank)
32 first working medium channel
33 second working medium channel
40 pressure intensifier
41 first compartment
42 second compartment
43 piston
451, 452 high-pressure cylinder
461, 462 plunger
53 pressure detector
68 feed port
69 reservoir
70 ultrahigh pressure generator
8A first low-pressure selector switch circuit
8B second low-pressure selector switch circuit
81 low-pressure channel
82 first check valve
83 second check valve
84 check valve connection channel
85 first switch channel
86 second switch channel

What is claimed is:

1. An ultrahigh pressure generator, comprising:

a pressure intensifier configured to discharge a fluid, the pressure intensifier including a piston configured to be driven by a working medium, a double-acting drive cylinder having a first compartment and a second compartment that are separated by the piston, a high-pressure cylinder configured to discharge the fluid, and a plunger configured to reciprocate in the high-pressure cylinder together with the piston;

a closed-circuit working medium pump having a first port and a second port being an inlet port and an outlet port, respectively, for the working medium, the closed-circuit working medium pump being configured to drive the pressure intensifier by sucking and discharging the working medium from and to the first compartment and the second compartment respectively through the first port and the second port;

a first working medium channel connecting the first compartment and the first port;

a second working medium channel connecting the second compartment and the second port;

a tank configured to store the working medium;

a feed circuit configured to feed the working medium from the tank to the first working medium channel and the second working medium channel;

a collector configured to collect the working medium from the first working medium channel and the second working medium channel into the tank; and a low-pressure selector configured to select, when the pressure of the working medium discharged toward the first compartment or the second compartment exceeds a predetermined threshold, the working medium discharged from one of the first compartment and the second compartment, and direct the selected working medium to the collector;

wherein the low-pressure selector includes a first low-pressure selector switch circuit configured to select, when the pressure of the working medium discharged toward the first compartment exceeds the predetermined threshold, the working medium discharged from the second compartment, and direct the selected working medium to the collector, and a second low-pressure selector switch circuit configured to select, when the pressure of the working medium discharged toward the second compartment exceeds the predetermined threshold, the working medium discharged from the first compartment, and direct the selected working medium to the collector.

2. The ultrahigh pressure generator according to claim 1, wherein the low-pressure selector includes a first check valve having a downstream end connecting to the first working medium channel;

a second check valve having a downstream end connecting to the second working medium channel;

a low-pressure channel connecting an upstream end of the first check valve and the second check valve to the collector;

a first switch channel connecting the first working medium channel to the upstream end of the second check valve; and a second switch channel connecting the second working medium channel to the upstream end of the first check valve.

3. The ultrahigh pressure generator according to claim 2, further comprising:

a high-pressure selector configured to select the working medium discharged from one of the first compartment and the second compartment, and direct the selected working medium to the collector, wherein the low-pressure selector is arranged between the high-pressure selector and the pressure intensifier.

4. The ultrahigh pressure generator according to claim 1, further comprising:

a high-pressure selector configured to select the working medium discharged from one of the first compartment and the second compartment, and direct the selected working medium to the collector, wherein the low-pressure selector is arranged between the high-pressure selector and the pressure intensifier.

5. An ultrahigh pressure generator, comprising:

a pressure intensifier configured to discharge a fluid, the pressure intensifier including a piston configured to be driven by a working medium, a double-acting drive cylinder having a first compartment and a second compartment that are separated by the piston, a high-pressure cylinder configured to discharge the fluid, and a plunger configured to reciprocate in the high-pressure cylinder together with the piston;

a closed-circuit working medium pump having a first port and a second port being an inlet port and an outlet port, respectively, for the working medium, the closed-circuit working medium pump being configured to drive the pressure intensifier by sucking and discharging the working medium from and to the first compartment and the second compartment respectively through the first port and the second port;

a first working medium channel connecting the first compartment and the first port;

a second working medium channel connecting the second compartment and the second port;

a tank configured to store the working medium;

a feed circuit configured to feed the working medium from the tank to the first working medium channel and the second working medium channel;

a collector configured to collect the working medium from the first working medium channel and the second working medium channel into the tank; and a low-pressure selector configured to select, when the pressure of the working medium discharged toward the first compartment or the second compartment exceeds a predetermined threshold, the working medium discharged from one of the first compartment and the second compartment, and direct the selected working medium to the collector;

wherein the low-pressure selector includes a first check valve having a downstream end connecting to the first working medium channel;

a second check valve having a downstream end connecting to the second working medium channel;

a low-pressure channel connecting an upstream end of the first check valve and the second check valve to the collector;

a first switch channel connecting the first working medium channel to the upstream end of the second check valve; and a second switch channel connecting the second working medium channel to the upstream end of the first check valve.

6. The ultrahigh pressure generator according to claim 5, further comprising:

a high-pressure selector configured to select the working medium discharged from one of the first compartment and the second compartment, and direct the selected working medium to the collector, wherein the low-pressure selector is arranged between the high-pressure selector and the pressure intensifier.

* * * * *